United States Patent [19]

Schaper

[11] Patent Number: 4,762,570

[45] Date of Patent: Aug. 9, 1988

[54] CONTINUOUSLY OPERABLE SUGAR CENTRIFUGE

[75] Inventor: Helmut Schaper, Braunschweig, Fed. Rep. of Germany

[73] Assignee: Braunschweigische Maschinenbauanstalt AG, Braunschweig, Fed. Rep. of Germany

[21] Appl. No.: 85,857

[22] Filed: Aug. 14, 1987

[30] Foreign Application Priority Data

Aug. 22, 1986 [DE] Fed. Rep. of Germany ..... 3628588

[51] Int. Cl.[4] ..... C13F 1/06

[52] U.S. Cl. ..... 127/19; 127/9; 210/380.1; 210/369

[58] Field of Search ..... 127/19, 9, 2; 210/380.1, 369

[56] References Cited

U.S. PATENT DOCUMENTS 3,108,067 10/1963 Dietzel et al. ..... 210/380.1

4,131,482 12/1978 Dietzel ..... 127/19

FOREIGN PATENT DOCUMENTS 100787 11/1978 Fed. Rep. of Germany .

OTHER PUBLICATIONS

Zucker, 13th year, Nr. 14, of Jul. 15, 1960.

*Primary Examiner*—Patrick P. Garvin

*Assistant Examiner*—Chung K. Pak

*Attorney, Agent, or Firm*—W. G. Fasse; D. H. Kane, Jr.

[57] ABSTRACT

The screen drum of a continuously operable sugar centrifuge is divided into three sections along its axial length from the drum bottom to the sugar discharge rim. A first upper section extends from the discharge rim downwardly. This first section has such a wall inclination ($\alpha$) relative to the central rotational axis that a layer of material being centrifuged remains stationary on the first section when the supply of massecuite is interrrupted and the supply of covering or wash-water is continued while the centrifuge keeps operating. A second mid-section extends along a mid-portion of the drum and another angle of inclination ($\beta$)relative to the rotational axis, whereby the angle ($\beta$) is larger by about 3° to 7° than the angle ($\alpha$). A third lower section encloses a third angle ($\gamma$) with the rotational drum axis. The third angle ($\gamma$) is about equal to the first angle ($\alpha$). A so constructed drum facilitates the control of variables which influence the distribution of the massecuite on ther inner surface of the screen drum. Specifically a more uniform distribution of the material on the inner drum surface is obtained with a layer thickness tapering toward the discharge rim.

5 Claims, 1 Drawing Sheet

CONTINUOUSLY OPERABLE SUGAR CENTRIFUGE

FIELD OF THE INVENTION

The invention relates to a continuously operable sugar centrifuge, more specifically, to a screen drum for such a continuously operable sugar centrifuge.

DESCRIPTION OF THE PRIOR ART

Sugar centrifuges of the above type have a frustum shaped screen drum which is mounted for rotation about a central vertical axis. The frustum shaped screen drum has a small end bottom and a large end sugar discharging upper rim. The drum proper is normally equipped with a screen which extends from the drum bottom or from the upper edge of a massecuite acceleration pot for introducing massecuite, to the zone of the sugar discharge rim. The drum proper and/or the screen may be divided into several sections which include different angles with the central rotational axis. Such centrifugals also include means for introducing massecuite at the bottom of the drum and for supplying wash water to the zone near the large diameter end section of the drum.

German Patent (DE-PS) No. 100,787 describes a continuously operable sugar centrifugal of the type described above in which the drum has the shape of a paraboloid for assuring a uniformly fast flow of the massecuite along all locations of the inner drum surface. Two partial drum sections may be arranged one on top of the other in the direction of the central rotational axis. Each section has the shape of a paraboloid as is shown in the German Patent No. 100,787. The two paraboloid drum sections are interconnected by a cylindrical drum section for providing an additional residence time of the massecuite as it travels from the lower paraboloid drum section to the upper paraboloid drum section.

One drawback of drums as disclosed in said German Patent is seen in that it is practically impossible to manufacture such drums because it is very difficult to adapt the screen sections to the shape of a paraboloid so that they properly fit into the drum sections having the shape of a paraboloid.

Another publication that appeared in the trade magazine "Zucker" (Sugar), Volume 13, No. 14, of July 15, 1960, by W. Dietzel, describes the working manner and field of application of continuously operable centrifugals in the sugar industry. This publication describes, among others, screen drums having three sections. The lowermost section near the bottom of the drum is a cylindrical section. The middle section is slanted relative to the central rotational axis by an inclination of 22°. The middle section is followed by a so-called large section having a slant relative to the central rotational axis of 35°. This type of drum has a different screen installed in each section for taking into account different characteristics of the massecuites.

Experience with the just discussed type of centrifugal has shown that the desired uniform centrifuging of the massecuite and of the wash water applied to the massecuite is not achieved. Further, even a uniform discharge of the centrifuged crystalline sugar mass over the discharge rim of the drum cannot be satisfactorily achieved by the type of drum described in the above mentioned publication "Zucker". Especially in connection with massecuites containing rough or large crystals, the desired uniformity in the centrifuging and in the sugar crystal discharge cannot be achieved.

As a result of the above practical experience, it can be said that at this time only continuously operable sugar centrifugals are used which have drums with a unifrom angle of inclination along their entire drum height, relative to the rotational axis.

Depending on the respective maximum or large diameter of the drum, and depending on the r.p.m., angles of inclination within the range of about 22° to 30° are conventionally used in order to achieve centrifuging numbers in the zone near the discharge rim of the drum, which are within the range of 2000 to 2500. These centrifuging numbers are defined as $$z=b/g=v^2/(g\cdot r),$$

wherein b is the centrifugal acceleration of the drum;

g is the gravitational acceleration;

r is the large end radius of the drum; and v is the circumferential speed of the drum.

The centrifuging number is a dimensionless value providing information regarding the operational efficacy of a sugar centrifugal.

OBJECTS OF THE INVENTION

In view of the foregoing it is the aim of the invention to achieve the following objects singly or in combination:

to easily adapt the layer thickness of the mass inside the centrifugal drum and the centrifuging time to the varying qualities or characteristics of the massecuite;

to positively influence the transport of the massecuite along the screen of the drum by influencing the effect of the centrifugal force component and of the pressure caused by the upwardly urging massecuite in the direction of the generatrix of the respective conical drum section;

to make sure that the number of drum sections is minimal so that also the number of screen sections can be minimal; and to take into account those variables which influence the massecuite differently as it passes from the bottom of the drum upwardly so that a uniform distribution is assured individually in each drum section, and so that the layer thickness tapers upwardly.

SUMMARY OF THE INVENTION

A sugar centrifuge of the above type is characterized according to the invention in that the drum and or the screen proper are divided into three sections, whereby the first or upper section between the discharge rim of the drum and the second or middle section, encloses such a first angle ($\alpha$) with the rotational central axis of the drum that during the operation the material layer remains stationary on this upper drum or screen section if the supply of the massecuite is interrupted while the supply of wash water to this zone is maintained, wherein the middle section encloses an angle ($\beta$) of inclination relative to the central rotational axis, which angle ($\beta$) is larger by about 3° to 7° than the first mentioned angle ($\alpha$), and wherein a lowermost section extends from the middle section to the massecuite supply means, said third section having an angle ($\gamma$) of inclination which corresponds approximately to the first mentioned angle ($\alpha$).

The construction of the centrifugal drum and/or screen according to the invention takes into account that in the narrow diameter or lower zone of the drum the liquid contained in the massecuite enhances the flowability of the massecuite so that relatively small discharge forces effective in the direction of the drum or cone generatrix are sufficient for transporting the massecuite toward the discharge rim in this lowermost zone. This is so because the liquid or syrup present in the massecuite acts as a lubricating agent between the crystals. The respective lubricating effect becomes smaller and smaller as the removal of liquid or syrup from the massecuite increases, whereby the flowability is also decreased in the middle zone or section of the centrifuge drum. Thus, it has been found that it is advantageous to provide the middle or central drum zone with a larger angle ($\beta$) of inclination relative to the angle of inclination of the lower massecuite supply zone. As a result, a larger discharge force is effective on the massecuite in this middle zone and the sliding of the massecuite is enhanced even without a liquid film on the screen proper. In this manner any tendency of the massecuite to come to rest on the surface of the screen is subject to a counter action caused by the above mentioned discharge force applied to the massecuite in this middle zone or section.

Further, the uppermost or first section again forms a smaller angle with the central rotational axis as compared to the angle of the middle section, whereby again the increasing discharge force in the large diameter section of the drum is taken into account as well as the effect of the wash water supply which normally takes place in this zone.

In conventional centrifuges having a uniform angle of inclination along the entire drum wall or screen proper, the following massecuite distribution has been observed. A thin layer is formed in the lower drum section near the area where massecuite is introduced. A larger layer thickness forms in the middle or central section due to the reduction in the liquid forming a lubricating agent. Additionally, in the central section there is the danger that the sugar crystals stick more strongly on the screen surface. A corrugated or washboard type of distribution in the layer thickness has been observed in the first upper section near the discharge end due to a respective distribution of the crystals in this discharge zone. A non-uniform layer thickness is not desirable in the upper section of the centrifuge because it leads to tearing in the discharged massecuite. Contrary to these drawbacks of the prior art, according to the invention a uniform distribution of the massecuite is achieved over the entire drum height on the drum or screen surface. The layer thickness becomes uniformly thinner or tapers toward the discharge zone. Localized accumulations of sugar crystals have been avoided. Thus, the mentioned tearing of the massecuite in the upper zone of the centrifuge is also avoided. These advantages cannot be achieved by conventional centrifugals.

The flowability, or rather slidability of the massecuite and the discharge force that is effective on the massecuite, depends on a number of parameters. Such parameters include, for example, the consistency or density of the massecuite, the size of the crystals, the mesh of the drum screen, the centrifuging number relevant to the particular centrifuge, and the residence time of the massecuite in the centrifuge. Therefore it is not possible to define absolute angular values which are applicable to all types of centrifuges, or rather to the sections of the centrifuge according to the invention, said angles being defined between the generatrix of the respective section and the central rotational axis of the drum or screen. Similarly, it is not possible to define absolute length values for the individual sections in the direction of the longitudinal axis.

Starting with a conventional drum and/or screen for such a drum, it has been found that the angle ($\beta$) according to the invention, namely the angle of the middle section, may correspond to the angle of inclination of an entire conventional drum wall. The angle of inclination of the first or upper drum section according to the invention, and of the third or lower drum section according to the invention is then made steeper by about 3° to 7°. Additionally, the r.p.m. according to the invention is adjusted so that the above mentioned conditions with regard to the centrifuging number (z) are satisfied in the first or upper section near the discharge rim. Thus, the invention achieves a uniform upward sliding of the layer toward the discharge rim as long as the supply of massecuite is maintained. However, when the supply of massecuite is stopped, the advance of the layer also stops even though the supply of wash water is maintained.

Similarly, it is possible to make the angle of inclination in the upper and lower sections steeper than is conventional and to make the angle of inclination in the central section to correspond to the inclination angle of the entire drum or screen wall in a conventional centrifuge. In both instances it is important that during the operation of the centrifuge the above mentioned conditions are maintained in the uppermost section neighboring the discharge rim or edge.

As far as the individual height of the several drum sections is concerned, the invention teaches that the uppermost section should have an axial height corresponding to about one third to 35% of the total axial drum height. The second section should have a height corresponding to about one third to 40% of the total height, while the last or lowermost section corresponds to about 25% to about one third of the total drum height. Thus, the third or lowermost section near the drum bottom can have an axial height somewhat smaller than the axial height of the two other sections.

A particular advantageous embodiment has a drum in which the first or upper section has a height taking up 35%, the middle section has a height of 40%, and the last section has a height of 25% of the total drum height.

Where massecuites of a higher degree of purity are to be centrifuged, it is suggested according to the invention that the above mentioned centrifuging number is within the range of 800 to 1500 in the zone of the discharge rim. In such a centrifuge the angle of inclination in the first and third zone or section should be 25° and the angle of inclination in the central section should be 30° for achieving a centrifuge number within the range of 800 to 1500.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
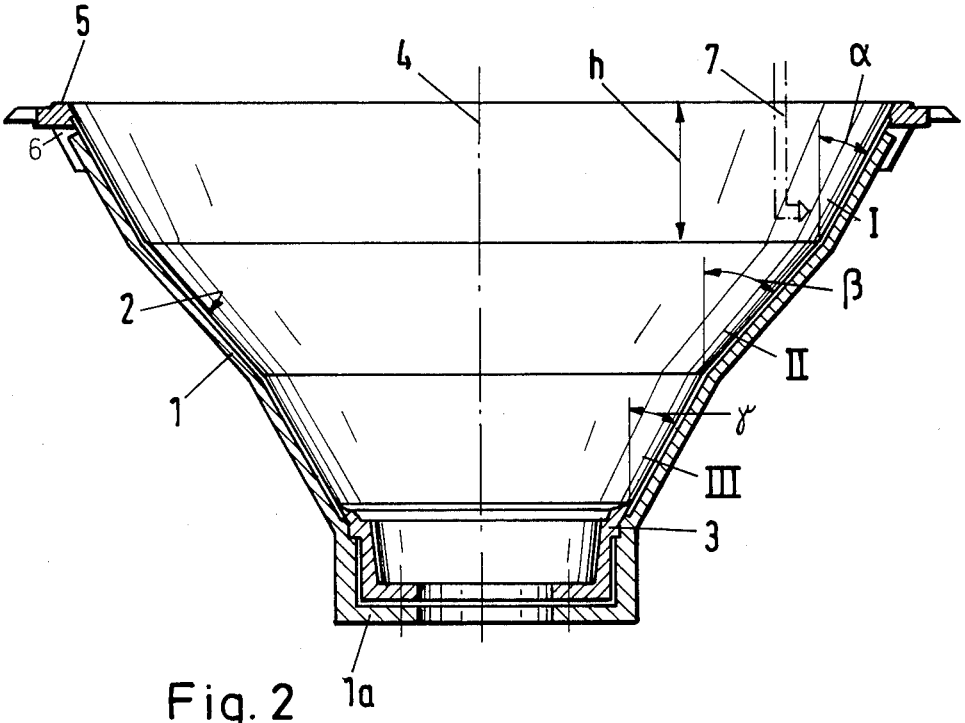
FIG. 1 is a sectional view through a centrifuging drum according to the invention and having an acceleration bell for the introduction of the massecuities.
Figure 2:
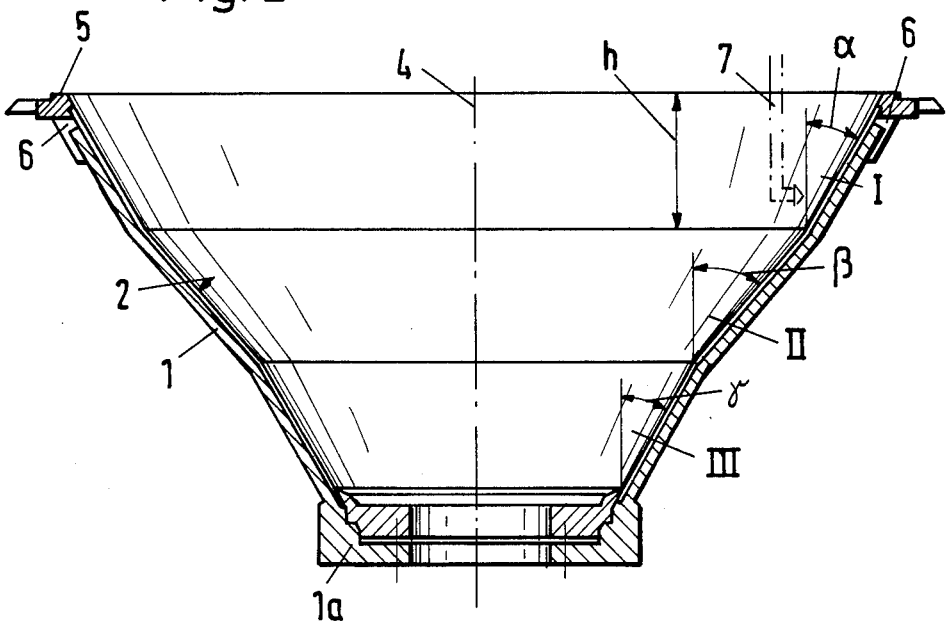
FIG. 2 is a sectional view similar to that of FIG. 1, however, showing a drum in which the screen reaches all the way down to the drum bottom.

As shown in FIGS. 1 and 2, the screen drum 1 comprises a screen 2 which is conventionally supported on the inner surface of the drum. In FIG. 1 the screen extends down to a massecuite distribution pot 3. In FIG. 2 the screen extends down to the drum bottom l*a*. The drum has a central rotational axis 4 and a generally frustum shaped conical configuration. The drum is conventionally rotatable by drive means not shown. A ring 5 forms a sugar discharge rim of the drum.

A liquid discharge gap 6 is formed between the rim 5 and the upper edge of the upper drum section I. The gap 6 communicates with the gap formed between the inner wall of the drum 1 and the screen 2 for discharging the liquid that passes through the screen and upwardly out through the gap 6. Thus, the liquid passes under the ring or rim 5 radially outwardly into a chamber surrounding the drum, but not shown. The sugar on the other hand, passes on the inside of the screen 2 upwardly and radially outwardly over the upper surface of the rim 5.

As shown in FIGS. 1 and 2, according to the invention, the drum 1 and the screen 2 are each divided into three sections I, II, and III, whereby in the shown example each section has approximately the same axial height as viewed in the direction of the central axis 4. This height is indicated by the double arrow h.

The upper and lower screen sections 1 and 3 have an angle of inclination ($\alpha$) and ($\gamma$) respectively. This angle is defined between the generatrix of the respective drum section and the rotational axis 4, or rather, a vertical line extending in parallel to the rotational axis 4. The angles ($\alpha$) and ($\gamma$) may be approximately equal to each other. The middle sectior II has an angle ($\beta$) of inclination relative to a vertical line in parallel to the rotational axis 4. The angle ($\beta$) is in the shown example larger than the angles ($\alpha$) and ($\gamma$), by an angular value of about 5°.

A conventional wash water supply 7 is shown by dash-dotted lines. The wash water supply 7 feeds the wash water to the lower area of the upper zone 1 to cover the layer of sugar crystals travelling upwardly.

According to the invention the angle ($\alpha$) of the section I is so selected that the advance of the massecuite at the given operational r.p.m. of the centrifuge drum stops if the supply of massecuite stops and even if the supply of wash water is continued. As soon as massecuite is supplied again, the upward advance of the layer is resumed, however in a tapering fashion so that the layer gets thinner and thinner closer to the discharge rim 5.

In the middle section II the inclination angle ($\beta$) is larger than the angles ($\alpha$) and/or ($\gamma$). In the section III the angle ($\gamma$) corresponds again, as mentioned above, approximately to the angle ($\alpha$).

It has been found that in spite of the different angles of inclination, it is easy to manufacture the respective screen sections of the screen 2 without any difficulties. This is so, because the screen 2 may itself be divided into several sections corresponding to the drum sections I, II, and III. Additionally, it is easy to mount the screen sections in the respective drum sections by a conventional clamping fit.

Although the invention has been described with reference to specific example embodiments, it will be appreciated that it is intended to cover all modifications and equivalents within the scope of the appended claims.

What I claim is:

1. In a continuously operable sugar centrifuge having a central rotational axis, the improvement comprising frustum shaped screen drum means for centrifuging massecuite, said screen drum means having three interconnected sections including a first upper section forming a sugar discharge rim at its upper wide diameter end, a second mid-section, and a third lower section, said screen drum means further including bottom means operatively connected to said third lower section at its lower small diameter end for feeding said massecuite onto said screen drum means, said first upper drum section having a first angle ($\alpha$) of inclination relative to said central rotational axis such that, during the rotation of said screen drum means a substantially crystallized massecuite layer remains stationary on said first upper drum section when the supply of said massecuite to said bottom means is stopped and when simultaneously the supply of wash-water is maintained, said second drum mid-section having a second angle ($\beta$) of inclination relative to said central rotational axis, said second angle ($\alpha$) being larger than said first angle ($\alpha$) by about 3° to about 7°, said third lower drum section having a third angle ($\gamma$) of inclination relative to said central axis, said third angle ($\gamma$) corresponding approximately to said first angle ($\alpha$), whereby a uniform distribution of the substantially crystallized massecuite being centrifuged on an inner drum surface is obtained with a layer thickness tapering toward said discharge rim.

2. The centrifduge of claim 1, wherein said screen drum includes three screen sections corresponding to said three drum sections, said screen sections having the same angular inclinations as the respective drum sections.

3. The centrifuge of claim 1, wherein said first upper drum section has an axial height corresponding to about 33% to about 35% of the total axial height of said screen drum, wherein said second drum mid-section has an axial height corresponding to about 33% to about 40% of said total axial height, and wherein said third lower drum section has an axial height corresponding to any remainder of said total axial height.

4. The centrifuge of claim 3, wherein said axial height of said first upper drum section corresponds to about 35% of said total axial height, wherein said axial height of said second drum mid-section corresponds to about 40% of said total axial height, and wherein said axial height of said third lower drum section corresponds to about 25% of said total axial height.

5. The centrifuge of claim 1, wherein said first angle ($\alpha$), and said third angle ($\gamma$) are each 25°, and wherein said second angle ($\beta$) is 30°.

* * * * *